United States Patent [19]

Tessaro

[11] Patent Number: 4,659,103

[45] Date of Patent: Apr. 21, 1987

[54] SELF-LOCKING BINDING PARTICULARLY FOR CROSS-COUNTRY SKIING

[75] Inventor: Mario Tessaro, Montebelluna, Italy

[73] Assignee: MATESS di Mario Tossaro, Montebelluna, Italy

[21] Appl. No.: 719,394

[22] Filed: Apr. 2, 1985

[30] Foreign Application Priority Data

Apr. 11, 1984 [IT] Italy ..... 41554A/84

[51] Int. Cl.[4] ..... A63C 9/18

[52] U.S. Cl. ..... 280/615

[58] Field of Search ..... 280/615

[56] References Cited

U.S. PATENT DOCUMENTS

| | | | |
|---|---|---|---|
| 4,219,216 | 8/1980 | Settembre | 280/615 |
| 4,239,257 | 12/1980 | Biermann | 280/615 |
| 4,322,091 | 3/1982 | Storandt | 280/615 |
| 4,452,467 | 6/1984 | Hetzelt | 280/615 |
| 4,533,154 | 8/1985 | Bernard et al. | 280/615 |

FOREIGN PATENT DOCUMENTS

| | | | |
|---|---|---|---|
| 0088673 | 9/1983 | European Pat. Off. | 280/615 |

*Primary Examiner*—John J. Love
*Assistant Examiner*—Eric D. Culbreth
*Attorney, Agent, or Firm*—Guido Modiano; Albert Josif

[57] ABSTRACT

The self-locking binding is adapted for automatically locking the lower toe portion of cross-country skiing footwear to a cross-country ski. The binding comprises a plate, associable with a ski which is adapted for engagement with a front oscillable element, forming a toe seat, the movement whereof is allowed by the interposition of a spring element between it, the plate, and a front release block. Rearward of the oscillable element there is journalled an adjustable device for locking the toe portion of a cross-country skiers' footwear in position, the toe portion being releasable from the oscillable element which is adapted to enable adjustment of its excursion.

15 Claims, 9 Drawing Figures

SELF-LOCKING BINDING PARTICULARLY FOR CROSS-COUNTRY SKIING

BACKGROUND OF THE INVENTION

This invention relates to a self-locking binding particularly for cross-country skiing.

Various types of bindings are currently provided for cross-country skiing; some include a plate, rigid with the ski and provided with stationary lugs protruding upwards, on which matingly shaped seats are to be placed which are formed in the toe portion of the footwear sole, which is in turn held in position on the ski by an upper locking element, all this being necessary in order to restrict sideplay between the footwear sole and the ski. Some of these bindings have, however, the disadvantage of assuming, once closed, a fixed position, alternate oscillation of the footwear in a vertical plane as generated by the movements of the cross-country skier being entrusted exclusively to elastic deformation of the forward portion of the footwear left unlocked by the binding, with evident problems of wear at the affected area.

Other known types of bindings all include fixed lugs, located on a plate or on an upper locking element, which may be inserted into matingly shaped zones formed on the toe portion of the footwear, the same being locked by an element adapted to exert pressure thereon. Such known types have, however, the disadvantage of permitting sideplay between the footwear and the ski in conjunction with inherent high stresses imposed on the binding.

SUMMARY OF THE INVENTION

It is the primary aim of this invention to obviate such prior drawbacks affecting known types of cross-country ski bindings, by providing a binding which permits a partial rocking movement thereof, relatively to the ski.

A further important object is to provide a binding which can prevent sideplay between the toe portion of the footwear and the ski.

Another important object is to provide a binding which favors oscillatory movement of the footwear as imposed by the movements of a cross-country skier.

Another object is to provide a binding which affords quick and easy locking and releasing of the toe.

A not unimportant object is to provide a binding, the oscillation whereof may be graduated and which enables the toe locking action of the binding to be adjusted.

These and other objects are achieved by a self-locking binding particularly for cross-country skiing, characterized in that it comprises a plate, associable with a ski, having means of engagement for a front rocking element wherewith a toe portion of ski footwear may be associated, said element being associated with a release means with elastic biasing means interposed therebetween, journalled thereto there being an adjustable device for locking the toe portion of ski footwear, means being provided for adjusting the travel distance of the rocking element and for releasing the locked toe portion of ski footwear therefrom.

BRIEF DESCRIPTION OF THE DRAWINGS

Further features and advantages of the invention will be apparent from the description of a preferred but not exclusive embodiment of the binding for distance skiing, as illustrated by way of example and not of limitation in the accompanying drawings, wherein.

DESCRIPTION OF THE PREFERRED EMBODIMENTS

Figure 1:
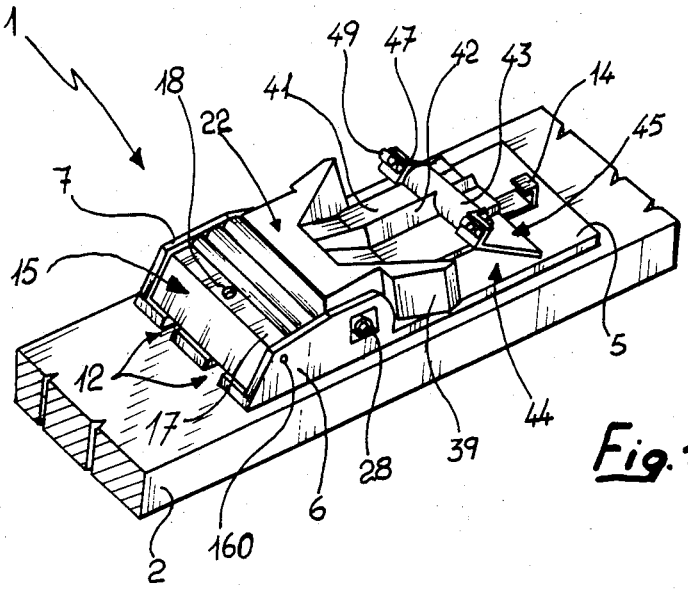
FIG. 1 is a perspective view of the binding according to the invention as fixed to a ski.
Figure 2:
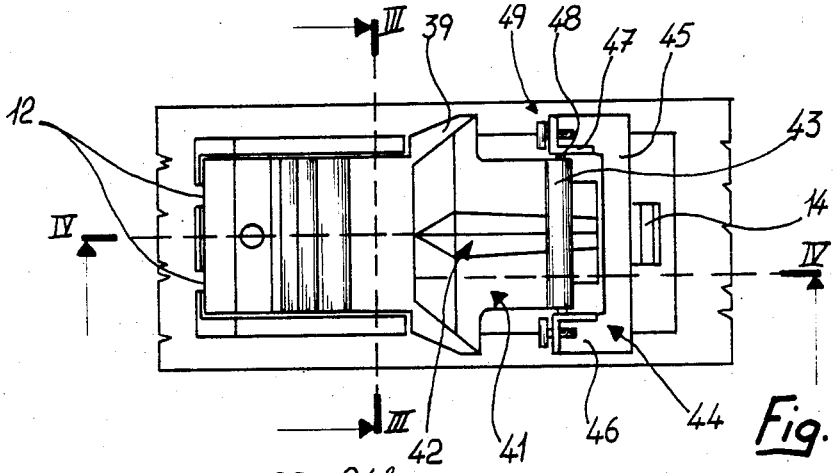
FIG. 2 is a top plan view of the invention.
Figure 3:
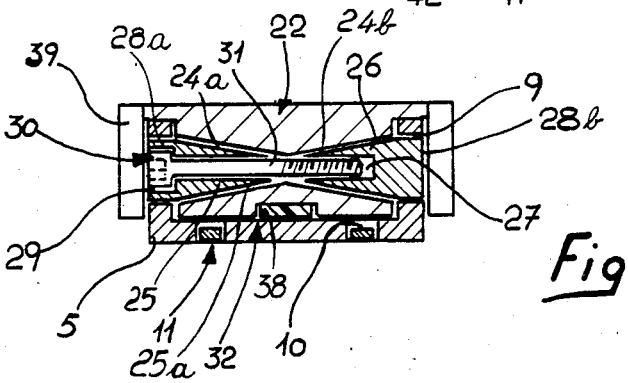
FIG. 3 is a sectional view taken on the line III—III of FIG. 2.

With reference to the cited drawing figures, the binding 1 is adapted for association with a cross-country ski 2 to automatically lock the toe portion 3 of a cross-country skiers' footwear 4 to the ski 2, the binding 1 comprises a parallelepipedal metal plate 5 associable with the upper surface of a ski 2. Forwardly, said plate 5 has two substantially symmetrical lateral shoulders 6 projecting orthogonally therefrom and being formed of the same material, said shoulders 6 being equally spaced with respect to the midlongitudinal axis of the plate 5, rigid therewith and extending forwardly on an inclined plane **6*a* which imparts them with a wedge-like outline. On each of the shoulders 6, there are also formed laterally and close to the top side 7 with a round hole 160 and a square shaped opening 9**, placed approximately at the same height.

The plate 5 is also provided downwardly with a seat 10, fashioned as a tuning fork for accommodating a matingly shaped metal foil 11, projecting forward along two longitudinal and parallel grooves 12 and being formed anteriorly with two lugs 13 and rearwardly with a grip hook 14, said foil 11 being slideable in the seat 10.

A member or release means 15, having a hole 8 formed therein, is, placed between the two shoulders 6, is journalled thereto by means of a pin 16 inserted through the holes 8, 160 is formed from the same material as used for the plate 5 and defines a substantially prismatic shape with a substantially triangular cross-section having an edge which follows the line of the plane **6*a* and an edge lying substantially parallel to a plane containing the plate 5. Rearwardly the release means 15 is provided, at the same height as the pin 16, with a parallelepipedal projection or rear portion 17, defining a length dimension which represents a fraction of the extension of the side 7 and upwardly whereof there is formed, at a middle cross-axis, a hemispherical seat or actuation seat 18, adapted for the insertion, for example, of the tip 19** of a ski pole.

In the lower zone 20 of the release means 15 there is formed a seat 21, aligned and shaped to mate with the lugs 13.

Between the shoulders 6, there is inserted moreover an oscillable element 22 of metal slightly raised with respect thereto and being formed with a substantially semicylindrical shaped zone 23, on the sides or end portions whereof, and at the axes of the holes 9, there are formed by milling two frusto-conical seats 24*a*, 24*b*, each converging inwardly towards the mid-axis of the element 22.

Into those seats 24*a*, 24*b* there are inserted two matingly shaped frusto-conical elements 25 and 26 respectively, the former having along the longitudinal axis a through hole 25*a*, and the other, again along the same axis, a blind hole 27 threaded internally and formed on the relatively smallest diameter section of the frusto-conical element 26, both of said frusto-conical elements 25, 26 having, however, the major diameter sections 28*a*, 28*b* of square shape, matingly shaped to engage in the square shaped openings 9.

The element 25 also has at the major diameter section 28*a* a seat 29 adapted to accommodate the head 30 of a screw 31 reversely threaded with respect to the blind hole 27.

The oscillable element 22 has, at the underside thereof, a milled groove 32 extending along its mid-longitudinal axis and communicating with a slightly deeper seat 33.

Upwardly there is formed instead, again by milling, a transverse seat 34, adapted for accommodating a tab 35 of a spring means 36 which may be fixed therein, for example by glueing, said spring means being interposed between the oscillable element 22 itself, the release means 15, and the plate 5.

The spring means 36 being shaped to mate with the rear portion of the cited release means 15 and the front portion of the substantially semicylindrical shaped zone 23, whilst downwardly it has a tab 37 terminated with a wedge 38, the latter being positionable in the milled groove 32 and seat 33 or millings.

The oscillable element 22 has rearwardly with respect to the seats 24 two projections 39 shaped for mating engagement with the sides of the toe portion 3 of a cross-country skiers' footwear 4, a zone or engagement seat 40 formed rearwardly of the zone 23, being adapted for receiving such a toe portion inserted thereinto.

The engagement seat 40 connects downwardly, along an inclined plane shaped for mating with a toe portion 3, to the base 41 of the oscillable element 22, which has a slightly smaller width dimension than that defined by the substantially semicylindrical shaped zone or forward zone 23 and being provided along the longitudinal axis with a projection 42 having a triangular cross-section, rigid with the base 41 and connected rearwardly and substantially perpendicularly to a cylindrical cross-piece 43, of the same width as the base 41 and rigid therewith.

Journalled to the sides of the cross-piece 43, is a locking device 44 comprising a metal plate 45 of U-like shape, which extends rearwards, and ideally to the base 41 without affecting however, in its projection, the grip hook 14, the width whereof is slightly greater than the corresponding width of the base 41 itself.

The metal plate 45 has forwardly, at two wings 46, two symmetrical L-like elements 47 rigid therewith, of the same material and being equally spaced with respect to the mid-longitudinal axis of the element 22, both having a seat, on the one side, for a pin 48 and, on the other side perpendicular thereto, for a screw 49 threadable therein.

The operation of the self-locking binding particularly for cross-country skiing will be now described.

Figure 4:
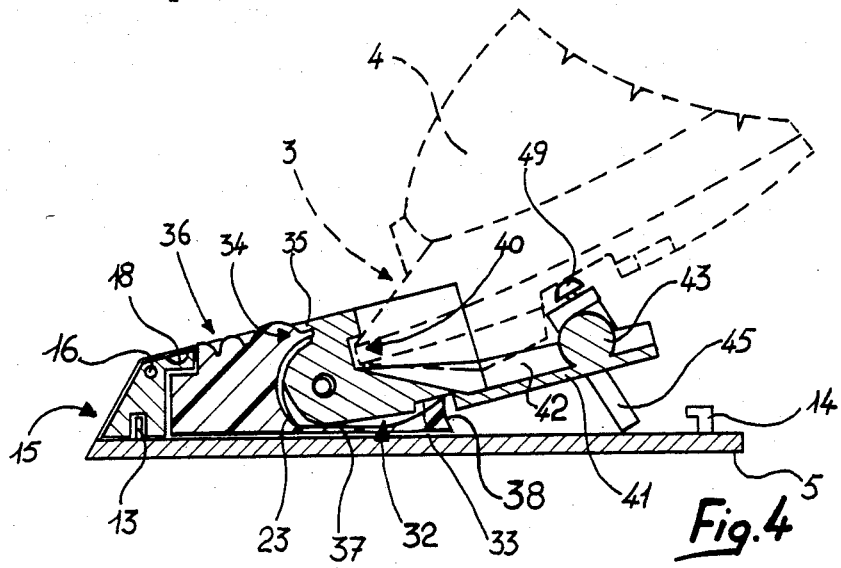
FIG. 4 is a sectional view taken on the line IV—IV of FIG. 2.

With the toe portion 3 of a cross-country skiers' footwear of the type including a seat 50 positioned as in FIG. 4, a slight pressure applied on the sole forces the plate 45 to rotate positioning the head of the screw 49 into alignment with the seat 50 formed downwardly of the sole of the skiers' footwear 4.

Further pressure forces the head of the screw 49 into the seat, the metal plate 45 positioning itself parallel to the base 41, this being optionally favored by the presence of the underlying plate 5. Adjustment being made by threading the screw 49 in or out.

Figure 5:
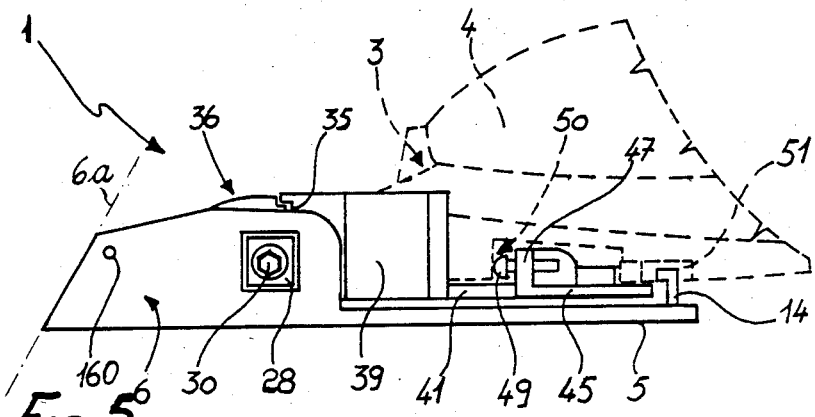
FIG. 5 is a side view of the invention showing relative positions of the binding and the toe portion of a skiers' footwear.

From FIG. 5 it may be seen how the plate 45 is ultimately positionable and how the grip hook 14 is adapted for accommodation in a seat 51 formed below the footwear sole, causing no inconvenience whatsoever for the user.

Figure 6:
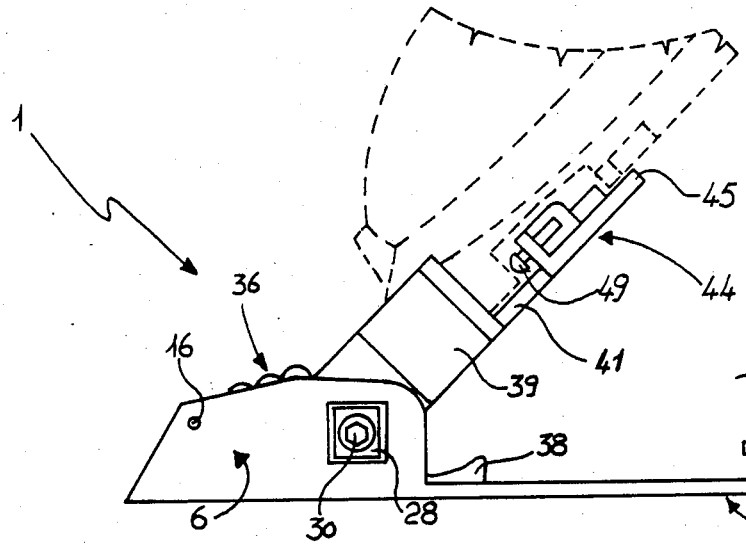
FIG. 6 is a side view, similar to FIG. 5, but showing a position which may be assumed whilst practicing cross-country skiing.

A second position is shown in FIG. 6: the shaping of the zone 23 allows for easy rotation of the oscillable element 22, whilst the elastic means 36, opposing the latter, is elastically deformed to then impart a biasing force which facilitates the oscillatory movement of the oscillable element.

To be underlined, moreover, is the fact that the wedge 38 properly positions the plate 41 for insertion of a footwear toe portion and at the same time facilitates the oscillatory movement of the element 22 when the sole of a skiers' footwear locked into the binding has been brought into contact with a ski whereto the binding is fixed.

Adjustment of the excursion of the oscillable element 22 is effected through the screw 31 which tightens or loosens the two frusto-conical elements 25 and 26.

Figure 7:
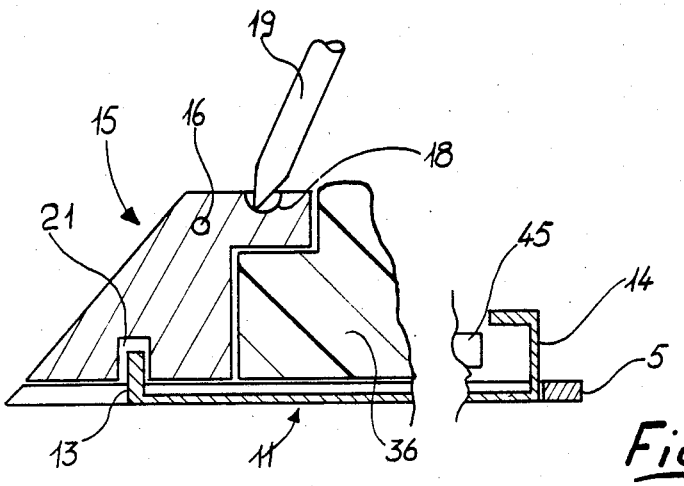
FIG. 7 shows how release of the footwear toe portion from the binding is performed.
Figure 8:
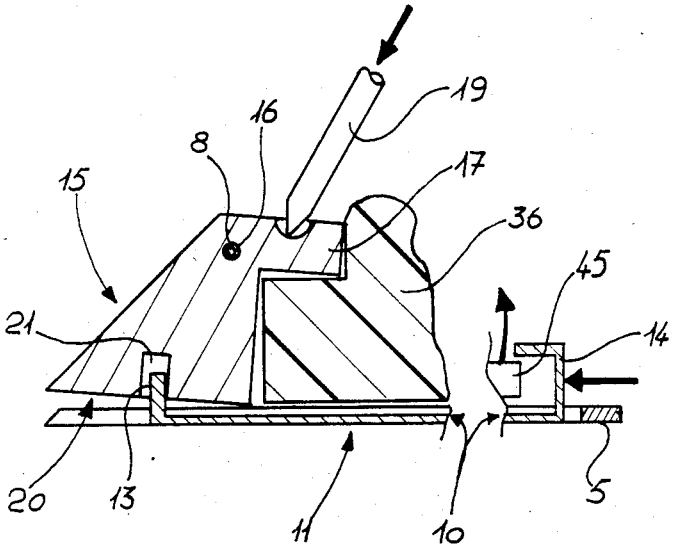
FIG. 8 shows the movement required to effect said release.

Release is shown in FIGS. 7 and 8; by applying with the tip 19 of a ski pole a pressure on the seat 18 of the release means 15, the latter is caused to rotate about the axis 16, this imparting a forward translation to the lugs 13 and hence to the grip hook 14 which hooks rearwardly on the plate 45.

Now, it will be sufficient to raise the sole, this movement allowing the plate 45 itself to rotate and hence the screw 49 to disengage from the seat 50.

It has been found in practice that the self-locking binding particularly for cross-country skiing herein has achieved all the objects set forth, enabling a proper oscillatory motion, preventing sideplay between the binding and the toe portion of footwear inserted thereinto, and enabling quick and easy locking and releasing of the toe portion. Furthermore, the excursion of the oscillable element may be graduated, in conjunction with the toe locking. The self-locking binding particularly for cross-country skiing as disclosed herein is susceptible to many modifications and changes falling within the same inventive concept.

Figure 9:
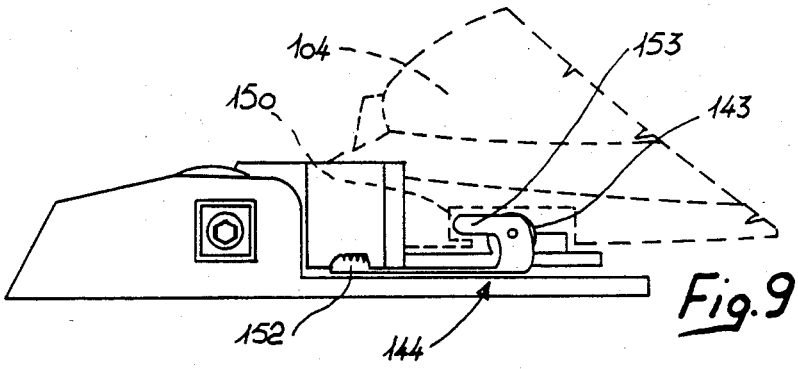
FIG. 9 illustrates a modified embodiment of the locking device of the binding.

In FIG. 9, for example, there is shown a variation of the locking device 144: it is composed of a pair of levers 152 journalled idly to the sides of the cross-piece 143 and interconnected by a metal element 153 matingly shaped for engagement in a seat 150 formed at the underside of the sole of a skiers' footwear 104.

That device 144 also affords a self-locking action, release being obtainable by acting directly on either of the levers 152.

Of course, the materials and dimensions may be any ones, depending on requirements.

I claim:

1. A self-locking binding particularly for cross-country skiing comprising a plate, an oscillable element, engagement means, release means, spring means and excursion adjustment means, said plate being adapted to be rigidly associated with an upper surface of a ski, said oscillable element being journalled to said plate and adapted for excursion defining oscillatory movement with respect to said plate, said spring means being adapted for biasing said oscillable element towards a plane overlying said plate, said engagement means being adapted for selectively releasably associating at least a toe portion of a cross-country skier's footwear with said oscillable element for co-direction oscillation therewith, said excursion adjustment means being adapted for adjusting said excursion defined by said oscillatory movement of said oscillable element, said release means being adapted for selectively releasing said toe portion of said cross-country skier's footwear from association with said oscillable element, said plate comprising a seat, sides and at least two substantially symmetrical shoulders, said shoulder each having a forward portion, a rear portion, and an upper edge, said shoulders extending upwardly from said sides of said plate, said oscillable element being journalled between said shoulders, on said forward portion of each of said shoulders there being formed, close to said upper edge thereof, a substantially circular hole, on said rear portion of each of said shoulders there being formed an aperture, said seat being formed downwardly on said plate and having a longitudinal extension, said self-locking binding further comprising a foil, said foil having at least two lugs, and at least one grip hook, said lugs being formed anteriorly on said foil, said grip hook being formed rearwardly on said foil, said seat being adapted for at least partially slideably accommodating said foil, for co-operation with said release means.

2. A self-locking binding according to claim 1 wherein said apertures have an axis and wherein said binding has a longitudinal axis, said oscillable element being located between said shoulders of said plate and having formed forwardly thereon a substantially semi-cylindrical zone having end portions, on said end portions of said semi-cylindrical zone and at said axis of said apertures formed on said shoulders there being formed at least two frusto conical seats, said frusto-conical seats being, adapted for communicating with each other, substantially symmetrically arranged and converging inwards, said semicylindrical zone having formed downwardly thereon a substantially flat base, said base having formed thereon at least one milling, said milling extending substantially along said longitudinal axis of said binding and defining at least two contiguous seats, said contiguous seats being adapted for at least partially accommodating said spring means.

3. A self-locking binding according to claim 1 wherein said oscillable element further comprises a first transverse seat, at least two side portions, a second transverse seat, a substantially flat base, and a projection having a substantially triangular cross-section, said first transverse seat being adapted for at least partially accommodating said spring means, said side portions being configured for mating substantially laterally with said toe portion of said cross-country skiers' footwear, said second transverse seat extending substantially parallel to said first transverse seat, being adapted for at least partially accommodating said toe portion of said cross-country skiers' foot wear, said binding having a longitudinal axis, said projection extending substantially from said second transverse seat to said flat base along said longitudinal axis.

4. A self locking binding according to claim 1 wherein said release means comprise a member, a pin, an actuation seat, a lug engagement seat and a rear projection, said member being journalled between said forward portions of said shoulders by means of said pin, inserted through said substantially circular hole formed on said foreward portion of each of said shoulders, said actuation seat being formed upwardly on said member and adapted to be acted on for causing rotation of said member relatively to said shoulders.

5. A self locking binding according to claim 1 wherein said oscillable element comprises a first transverse seat, a first transverse milling and a substantially semi-cylindrical zone having a front portion, and wherein said spring means comprises at least one elastically deformable element adapted for biasing said release means and said oscillable element towards a position overlying said plate, said elastically deformable element having a top rear end, a tab, a bottom rear end and a wedge, said top rear end being attached to said first transverse seat of said oscillable element, said tab being defined at said bottom rear end thereof, said wedge being defined on said tab and adapted for being at least partially, temporarily accommodated in said first transverse milling, said spring means being shaped for mating with said release means.

6. A self-locking binding according to claim 1 further comprising a grip hook, a foil, a cross-piece having cross-piece sides and a locking device, said grip hook being rigidly associated with said foil, said cross-piece being rigidly associated with said oscillable element, said locking device comprising a plate member having at least two wings, at least two substantially L-like elements each having a pin seat and a threaded seat formed therein at least two screws and at least two pins, said wings of said plate member being journalled to said cross-piece sides, said wings being rigidly associated with said plate member, each of said wings having rigidly associated therewith at least one of said substantially L-like elements, there being defined on each of said L-like elements at least one of said seats and at least one of said threaded seats, adapted for partially accommodating said pins and said screws respectively, said pins being adapted for rotatably attaching said L-like elements to said cross-piece sides, said screws being adapted for engagement with a seat formed in the sole of a cross-country skiers' footwear, said foil being adapted to be moved upon actuation of said release means, for selectively causing at least temporary engagement of said grip hook with said plate member.

7. A self-locking binding according to claim 1 wherein said excursion adjustment means comprise at least two frusto conical seats, at least two frusto conical elements each having a longitudinal axis and a largest diameter section, and a tightening screw, said frusto conical seats being formed in said oscillable element, said largest diameter sections of said frusto conical elements being adapted for engagement with said apertures, said frusto conical seats being adapted for at least partially accommodating said frusto conical elements, said tightening screw being adapted for interconnecting said frusto conical elements by screw thread engagement relationship therewith, and adapted to be tightened or loosened for adjusting said excursion defining oscillatory movement of said oscillable element.

8. A self-locking binding according to claim 1 wherein said excursion adjustment means comprise at least two frusto conical seats, at least two frusto conical elements each having a longitudinal axis and a largest diameter section, and a tightening screw having a head and a threaded portion, said frusto conical seats being formed in said oscillable element, said largest diameter sections of said frusto conical elements being adapted for engagement with said apertures, said frusto conical seats being adapted for at least partially accommodating said frusto conical elements, one of said frustoconical elements having formed therein an axially extending through hole, another of said frusto-conical element having formed therein an axially extending threaded hole, said tightening screw being adapted for being located in said through hole, with said head located exteriorly thereof and said threaded portion in screw thread engagement with said threaded hole, rotational movement of said tightening screw being effective to adjust said excursion defining oscillatory movement of said oscillable element.

9. A self-locking binding particularly for cross-country skiing comprising a plate, an oscillable element, engagement means, release means, spring means and excursion adjustment means, said plate being adapted to be rigidly associated with an upper surface of a ski, said oscillable element being journalled to said plate and adapted for excursion defining oscillatory movement with respect to said plate, said spring means being adapted for biasing said oscillable element towards a plane overlying said plate, said engagement means being adapted for selectively releasably associating at least a toe portion of a cross-country skier's footwear with said oscillable element for co-direction oscillation therewith, said excursion adjustment means being adapted for adjusting said excursion defined by said oscillatory movement of said oscillable element, said release means being adapted for selectively releasing said toe portion of said cross-country skier's footwear from association with said oscillable element, said plate comprising a seat, sides and at least two substantially symmetrical shoulders, said shoulder each having a forward portion, a rear portion, and an upper edge, said shoulders extending upwardly from said sides of said plate, said oscillable element being journalled between said shoulders, on said forward portion of each of said shoulders there being formed, close to said upper edge thereof, a substantially circular hole, on said rear portion of each of said shoulders there being formed an aperture, said seat being formed downwardly on said plate and having a longitudinal extension, said self-locking binding further comprising a foil, said foil having at least two lugs, and at least one grip hook, said lugs being formed anteriorly on said foil, said grip hook being formed rearwardly on said foil, said seat being adapted for at least partially slideably accommodating said foil, for co-operation with said release means, said spring means comprising at least one elastically deformable element adapted for biasing said release means and said oscillable element towards a position overlying said plate.

10. A self-locking binding particularly for cross-country skiing comprising a plate including lateral shoulders, an oscillable element, engegement means, release means, spring means and excursion adjustment means, said plate being adapted to be rigidly associated with an upper surface of a ski, said oscillable element being journalled to said plate between said lateral shoulders thereof, and adapted for excursion defining oscillatory movement with respect to said plate, said spring means being adapted for biasing said oscillable element towards a plane overlying said plate, said engagement means being adapted for selectively releasably associating at least a toe portion of a cross-country skier's footwear with said oscillable element for co-directional oscillation therewith, said release means being adapted for selectively releasing said toe portion of said cross-country skiers' footwear from association with said oscillable element, each of said lateral shoulders having formed therein an aperture, said excursion adjustment means comprising at least two frusto-conical seats, at least two frusto-conical elements each having a longitudinal axis and a largest diameter section, and a tightening screw having a head and a threaded portion, said frusto-conical seats being formed in said oscillable element, said largest diameter sections of said frusto-conical elements being adapted for engagement with said apertures, said frusto conical seats being adapted for at least partially accommodating said frusto conical elements, one of said frustoconical elements having formed therein an axially extending through hole, another of said frusto-conical element having formed therein an axially extending threaded hole, said tightening screw being adapted for being located in said throughhole, with said head located exteriorly thereof and said threaded portion in screw thread engagement with said threaded hole, rotational movement of said tightening screw being effective to adjust said excursion defining oscillatory movement of said oscillable element.

11. A self-locking binding according to claim 10 wherein said oscillable element further comprises a first transverse seat, at least two side portions, a second transverse seat, a substantially flat base, and a projection having a substantially triangular cross-section, said first transverse seat being adapted for at least partially accommodating said spring means, said side portions being configured for mating substantially laterally with said toe portion of said cross-country skiers' footwear, said second transverse seat extending substantially parallel to said first transverse seat, being adapted for at least partially accommodating said toe portion of said cross-country skiers' foot wear, said binding having a longitudinal axis, said projection extending substantially from said second transverse seat to said flat base along said longitudinal axis.

12. A self-locking binding according to claim 10 wherein said apertures have an axis and wherein said binding has a longitudinal axis, said oscillable element being located between said shoulders of said plate and having formed forwardly thereon a substantially semicylindrical zone having end portions, said frusto-conical seats being formed on said end portions of said semicylindrical zone and at said axis of said apertures formed on said shoulders, said frusto-conical seats being, adapted for communicating with each other, substantially symmetrically arranged and converging inwards, said semicylindrical zone having formed downwardly thereon a substantially flat base, said base having formed thereon at least one milling, said milling extending substantially along said longitudinal axis of said binding and defining at least two contiguous seats, said contiguous seat being adapted for at least partially accommodating said spring means.

13. A self locking binding according to claim 10 wherein said spring means comprises at least one elastically deformable element adapted for biasing said release means and said oscillable element towards a position overlying said plate.

14. A self locking binding according to claim 10 wherein said oscillable element comprises a first transverse seat, a first transverse milling and a substantially semi-cylindrical zone having a front portion, and wherein said spring means comprises at least one elastically deformable element adapted for biasing said release means and said oscillable element towards a position overlying said plate, said elastically deformable element having a top rear end, a tab, a bottom rear end and a wedge, said top rear end being attached to said first transverse seat of said oscillable element, said tab being defined at said bottom rear end thereof, said wedge being defined on said tab and adapted for being at least partially, temporarily accommodated in said first transverse milling, said spring means being shaped for mating with said release means.

15. A self-locking binding according to claim 10 further comprising a grip hook, a foil, a cross-piece having cross-piece sides and a locking device, said grip hook being rigidly associated with said foil, said cross-piece being rigidly associated with said oscillable element, said locking device comprising a plate member having at least two wings, at least two substantially L-like elements each having a pin seat and a threaded seat formed therein at least two screws and at least two pins, said wings of said plate member being journalled to said cross-piece sides, said wings being rigidly associated with said plate member, each of said wings having rigidly associated therewith at least one of said substantially L-like elements, there being defined on each of said L-like elements at least one of said seats and at least one of said threaded seats, adapted for partially accommodating said pins and said screws respectively, said pins being adapted for rotatably attaching said L-like elements to said cross-piece sides, said screws being adapted for engagement with a seat formed in the sole of a cross-country skiers' footwear, said foil being adapted to be moved upon actuation of said release means, for selectively causing at least temporary engagement of said grip hook with said plate member.

* * * * *